US008511817B2

(12) United States Patent
Shinagawa et al.

(10) Patent No.: US 8,511,817 B2
(45) Date of Patent: Aug. 20, 2013

(54) RECORDING DEVICE

(75) Inventors: Yu Shinagawa, Shiojiri (JP); Hiroki Chino, Matsumoto (JP); Takayuki Shiota, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 320 days.

(21) Appl. No.: 13/116,351

(22) Filed: May 26, 2011

(65) Prior Publication Data

US 2011/0292148 A1 Dec. 1, 2011

(30) Foreign Application Priority Data

May 31, 2010 (JP) ..... 2010-123910

(51) Int. Cl.
*B41J 2/01* (2006.01)
*B41J 29/13* (2006.01)
*B65H 5/00* (2006.01)

(52) U.S. Cl.
USPC ..... 347/104; 347/108; 271/264

(58) Field of Classification Search
USPC ..... 347/104, 108; 271/264
See application file for complete search history.

(56) References Cited

U.S. PATENT DOCUMENTS

2006/0236331 A1 10/2006 Ueda et al.

FOREIGN PATENT DOCUMENTS

| | | | |
|---|---|---|---|
| JP | 2000-335769 | | 12/2000 |
| JP | 2000335769 A | * | 12/2000 |
| JP | 2006-124131 | | 5/2006 |
| JP | 2006124131 A | * | 5/2006 |

* cited by examiner

*Primary Examiner* — Stephen Meier
*Assistant Examiner* — Sarah Al Hashimi
(74) *Attorney, Agent, or Firm* — Workman Nydegger

(57) ABSTRACT

A recording device includes a cassette having a protruding portion; a lever as a transmission member in which the distance from a shaft portion to an abutting portion is shorter than the distance from the shaft portion to a connection portion, the lever transmitting a force that the abutting portion receives from the cassette to the connection portion as an acting force by rotating on shaft portion as the axis when the protruding portion of the cassette abuts on the abutting portion; a damper mechanism portion; a separation slope separating the papers; and a stopper as a restriction member restricting the movement of the papers at an upstream side position in the installation direction of the separation slope, and releasing the restriction on the movement of papers by retreating from the position where the stopper restricts the papers when receiving the acting force from the damper mechanism portion.

6 Claims, 12 Drawing Sheets

RECORDING DEVICE

CROSS REFERENCES TO RELATED APPLICATIONS

The present invention contains subject matter related to Japanese Patent Application No. 2010-123910, filed May 31, 2010, the entire contents of which are incorporated herein by reference.

BACKGROUND

1. Technical Field

The present invention relates to a recording device.

2. Related Art

Hitherto, as a kind of recording device, there has been an ink jet printer (hereinafter, referred to as a "printer"). In such a printer, the uppermost paper is taken out of a paper feeding cassette (hereinafter, referred to as a "cassette") in which a plurality of stacked recording media (for example, printing papers, hereinafter, referred to as "paper") is disposed, and the paper is fed sheet by sheet to a recording portion (printing portion), whereby printing is performed.

This type of printer is provided with an installation portion for installing a cassette and a paper feeding roller for feeding papers. When the cassette in which a plurality of papers is stacked is installed in the installation portion, the paper feeding roller is then rotated, whereby a paper feeding operation is performed in which the uppermost paper disposed in the cassette is taken out of the cassette and fed to a printing portion side.

When a user installs the cassette in the installation portion, in the side of a surface abutting the end portion in the installation direction of the papers accommodated in the cassette, there is formed a separation slope for guiding a plurality of sheets of papers accommodated in the cassette to the recording portion side while separating the papers sheet by sheet. However, if the user installs the cassette strongly, the papers ride on the separation slope in some cases. In this case, the plurality of sheets of papers cannot be separated sheet by sheet, which leads to double feeding of paper. The double feeding of paper leads to a concern over the occurrence of problems such as a paper jam.

Meanwhile, a method of gently installing the cassette is also considered to prevent the paper from riding on the separation slope; however, in this case, the user would become unnecessarily cautious, thus this is not preferable. Moreover, even when the cassette is gently installed, the papers ride on the separation slope in many cases.

For example, in Japanese Patent No. 3538569, there is provided a shutter member descending from a retraction position in the upper side to restrict the end portion of a paper-feeding side. When the shutter member ascends to the retraction position in the upper side, the lower end portion thereof is caused to rotate toward the upstream side in a paper feeding direction. As a result, it is possible to align the papers in a slanted state where the papers are positioned in the paper feeding direction in order, as the end portion of each paper abutting on the shutter member becomes the upper side.

However, in the Japanese Patent No. 3538569, the shutter member is caused to rotate and slide to the retraction position. Therefore, it is necessary to make a space for providing a rotation mechanism and a slide mechanism. Furthermore, it is necessary to make a space for accommodating the shutter member, the rotation mechanism and the slide mechanism in the retraction position. As a result, the device is scaled up.

Hence, for example, a method is implemented in which a restriction surface for restricting paper movement and a rotating stopper member are provided to restrict the paper movement when the restriction surface is in a direction crossing the separation slope and to release the restriction on the paper movement when the restriction surface retreats from the separation slope due to the rotation of the stopper member. This method makes it unnecessary to make the space for accommodating the stopper member, the rotation mechanism and the slide mechanism in the retraction position.

As a power source for rotating the stopper member, there is used a force which is generated when the user carries the cassette loaded with papers and installs it by pushing it into the installation portion of the printer in the installation direction and is applied to the cassette. The installation portion of the printer includes a power transmission unit transmitting the power for rotating the stopper member, and the cassette includes a protruding portion protruding to the installation portion to abut on an abutting portion of the power transmission unit. Accordingly, since the protruding portion should be provided in the cassette, the length of the cassette is elongated in the installation direction, which causes a problem that the cassette cannot be made small.

SUMMARY

An advantage of some aspects of the invention is that the invention can be realized by the following aspects or applications.

Application 1

A recording device including a cassette in which a plurality of recording media is accommodated by being stacked; an installation portion in which the cassette is installed due to the movement of the cassette in installation direction; a transmission member which has a shaft portion, an abutting portion, and a connection portion, wherein the distance between the shaft portion and the abutting portion is shorter than the distance between the shaft portion and the connection portion, the transmission member transmitting a force that the abutting portion receives from the cassette to the connection portion as an acting force by rotating on the shaft portion as a rotation axis when the cassette abuts on the abutting portion due to the movement of the cassette in the installation direction; a damper mechanism portion connected to the connection portion in the transmission member and receiving the acting force from the connection portion; a separation slope positioned at the downstream side in the installation direction of the cassette and separating the recording media; and a restriction member connected to the damper mechanism portion, restricting the movement of the recording media at an upstream side position in the installation direction of the separation slope, and releasing the restriction on the movement of the recording media by retreating from the position when receiving the acting force from the damper mechanism portion.

According to this configuration, there is provided a transmission member which includes a shaft portion, an abutting portion and a connection portion, wherein the distance between the shaft portion and the abutting portion is shorter than the distance between the shaft portion and the connection portion, the transmission member transmitting a force that the abutting portion receives from the cassette to the connection portion as the acting force by rotating on the shaft portion as a rotation axis when the protruding portion of the cassette abuts on the abutting portion due to the movement of the cassette in the installation direction.

As a result, it is possible to make the movement distance of the abutting portion shorter than that of the connection portion in the installation direction. Accordingly, the position of the abutting portion abutting on the protruding portion of the cassette at a point of time when the restriction on the movement of the recording media is released by the retraction of the restriction member from the upstream side position of the separation slope can be made close to the cassette body in the installation direction. Therefore, since the length of the protruding portion in the installation direction can be shortened, the entire length of the cassette including the cassette body and the protruding portion in the installation direction can be shortened, hence the cassette can be made small.

Application 2

The recording device wherein the transmission member includes a first lever having the shaft portion and the abutting portion and a second lever having the shaft portion and the connection portion.

According to this configuration, since the recording device can be configured with one member, the increase in production cost can be inhibited.

Application 3

The recording device wherein the damper mechanism portion includes a first damper portion having a first sliding member-sliding surface, a second sliding member-sliding surface and a viscous material provided between the first sliding member-sliding surface and the second sliding member-sliding surface.

According to this configuration, it is possible for the first damper portion to absorb the acting force received from the transmission member so as to slow down the retraction speed of the restriction member or delay the starting time point of the retraction movement of the restriction member.

Application 4

The recording device wherein the damper mechanism portion includes a second damper portion having an elastic member.

According to this configuration, it is possible for the second damper portion to absorb the acting force received from the transmission member so as to slow down the retraction speed of the restriction member or delay the starting time point of the retraction movement of the restriction member.

Application 5

The recording device wherein, when the cassette moves in the installation direction while abutting on the abutting member, a vertical line is included in each positional range of the rotation angle on the rotation axis as a center in at least one of the abutting member and the connection portion.

According to this configuration, if a vertical line is included in the positional range of the rotation angle around the rotation axis as a center in the abutting portion, the force in the tangential direction received from the cassette in the abutting portion increases. Therefore, it is possible to increase the torque for rotating the transmission member, so the transmission member can be efficiently rotated. Furthermore, if a vertical line is included in the positional range of the rotation angle around the rotation axis as a center in the connection portion, the angle in a direction of a line connecting a movement starting position and a movement ending position of the connection portion with respect to the installation direction of the cassette is reduced. Therefore, it is possible to elongate the movement distance in the installation direction of the cassette.

Application 6

The recording device wherein the vertical line is positioned at the center of the positional range of the rotation angle.

According to this configuration, if the vertical line is positioned at the center of the positional range of the rotation angle in the abutting portion, it is possible to more efficiently rotate the transmission member. Moreover, if the vertical line is positioned at the center of the positional range of the rotation angle in the connection portion, it is possible to further elongate the movement distance in the installation direction of the cassette.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiment will be described with reference to drawings. The embodiment shows an example of embodiments; therefore, the invention is not limited thereto, and the embodiment can be arbitrarily modified within the range of the technical scope of the invention. Also, in the following drawings, the scales and numbers of the respective structures differ from those of the actual structures to facilitate understanding of the respective configurations.

First Embodiment

Figure 1:
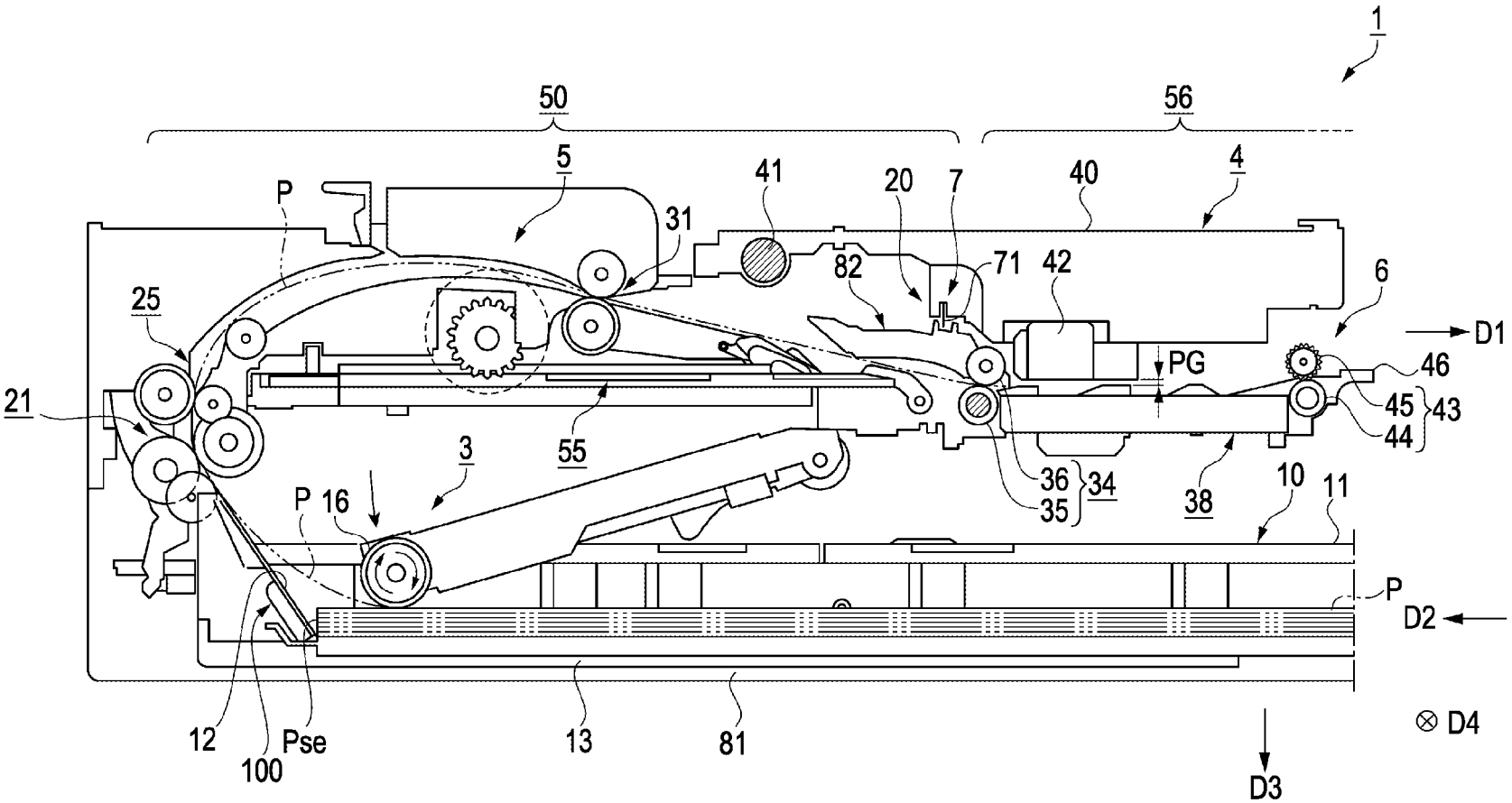
FIG. 1 is a cross sectional view showing an internal structure of a recording device.

FIG. 1 is a cross sectional view showing an internal structure of a recording device according to the embodiment. Hereinbelow, the recording device will be described by exemplifying an ink jet printer (hereinafter, referred to as a "printer").

As shown in FIG. 1, the recording device 1 in the embodiment is a printer in which a recording head 42 is mounted on the bottom surface of a carriage 40 which crosses a transport direction D1 in a recording execution area 56 and can reciprocate in a width direction D4 that is a vertical direction with respect to the drawing.

The recording device 1 includes a loading device 10 accommodating a printing paper (hereinafter, referred to as "paper") P as a plurality of recording media, a feeding device 3 feeding the paper P, a recording portion 4 performing recording on the paper P, a transport device 5 transporting the paper P along a transport path, an encoder device 7 detecting the position of the carriage 40, a discharge device 6 discharging the paper P to the transport direction D1 and a control portion (not shown) generally controlling the operation of the respective constituent devices.

The loading device 10 includes a cassette 11 in which a plurality of sheets of the paper P is accommodated by being stacked, an installation portion 13 in which the cassette 11 is installed, a separation slope 12 and a restriction unit 100. A user of the recording device 1 installs the cassette 11 to the installation portion 13 in an installation direction D2.

The installation portion 13 is provided with a guide portion (not shown) guiding the cassette 11 to the installation direction D2 when the user moves the cassette 11 in the installation direction D2. The installation portion 13 can fix the cassette 11 to a predetermined position with respect to the separation slope 12. When the user moves the cassette 11 from the position to which the cassette 11 is fixed by the installation portion 13 to the opposite side of the installation direction D2, the cassette 11 is taken out of the installation portion 13.

The separation slope 12 is disposed at the downstream side in the installation direction D2 of the cassette 11. The separation slope 12 includes a slope for guiding a plurality of sheets of the paper P accommodated in the cassette 11 to the recording portion 4 side while separating the paper P sheet by sheet and serves as a transport path in which the paper P is transported sheet by sheet.

The restriction unit 100 restricts an end portion Pse to the separation slope 12 side of the paper P when the cassette 11 in which a plurality of sheets of paper P is accommodated is installed in the installation portion 13. Also, when the cassette 11 has been installed in the installation portion 13, the restriction unit 100 releases the restriction on the end portion Pse with a time difference.

The feeding device 3 includes a pickup roller 16 transporting an uppermost one among the paper P accommodated in the cassette 11 to the separation slope 12 side in order, a separation roller 21 completely separating a following paper P failing to be separated from the uppermost paper P when guiding the transported uppermost paper P to a U-shaped inverse path 50 while separating the uppermost paper P and intermediate transport rollers 25 and 31 transporting the paper P along the U-shaped inverse path 50.

The transport device 5 includes a loading device 10 described above, a unit frame 81, a transport roller 34, a following transport roller holder 82, a tray 55 and the like. The transport roller 34 includes a driving transport roller 35 and a following transport roller 36. On the unit frame 81, there are mounted the loading device 10, the driving transport roller 35, the following transport roller holder 82 and the tray 55. Also, the unit frame 81 is provided with a supporting member 38 supporting the transport posture of the paper P.

The following transport roller 36 is supported in the following transport roller holder 82 through a plurality of axes. A plurality of bias springs (not shown) is connected to the following transport roller holder 82, and by the elasticity of the biasing springs, the following transport roller 36 is biased to the driving transport roller 35 at all times.

The recording portion 4 includes the recording head 42 performing recording on the paper P, and the carriage 40 on which the recording head 42 is mounted. The recording head 42 is mounted on the bottom of the carriage 40 holding ink cartridges (not shown). The recording head 42 is so disposed that it faces the supporting member 38 provided at the downstream side from the transport roller 34 in the vertical direction in the transport path of the paper P. Furthermore, predetermined recording is performed on the paper P fed on the supporting member 38 by the transport roller 34.

The carriage 40 is held by a carriage guide axis 41 mounted on the unit frame 81. The carriage 40 is connected to a carriage motor (not shown) through a timing belt (not shown). Accordingly, when the carriage motor is driven, the carriage 40 reciprocates in the scanning direction (the width direction of the paper P) D4 vertical to the drawing along the carriage guide axis 41.

The carriage 40 can change a gap PG between the supporting member 38 and the recording head 42 according to the thickness of the paper P or the like by vertically moving in the vertical direction D3 with respect to the supporting member 38 while being supported by the carriage guide axis 41 as a pivot. Also, ink cartridges (not shown) are detachably mounted on the carriage 40. The ink in the ink cartridges is provided to the recording head 42.

The encoder device 7 detects the position of the carriage 40 in the scanning direction D4 and includes an encoder scale 71 having a predetermined pattern formed therein and a detection sensor 20 optically detecting the pattern of the encoder scale 71.

The encoder scale 71 is provided in the unit frame 81 so as to extend in the scanning direction D4. In the encoder scale 71, a predetermined pattern is formed in which a light-shielding portion and a transmission portion are alternately disposed over the scanning direction D4.

The detection sensor 20 is provided in an integrated manner on the back side of the carriage 40. By moving along with the carriage 40, the detection sensor 20 reads a predetermined pattern formed in the encoder scale 71 and detects the movement amount of the carriage 40. As the detection sensor 20, it is possible to use an optical sensor or a magnetic sensor, for example.

The discharge device 6 includes a discharge roller 43 and a discharge stacker 46. The discharge roller 43 includes a driving discharge roller 44 and a following discharge roller 45. The paper P transported by the rotation of the transport roller 34 is fed to the discharge roller 43 through the supporting member 38. The driving discharge roller 44 and the driving transport roller 35 are connected to the same driving motor, hence they operate in association with each other.

The discharge stacker 46 is for stacking the paper P after recording into a pile and is provided on the upper side of the cassette 11-installed surface.

In the recording device 1, when the user moves the cassette 11 in the installation direction D2 and installs the cassette 11 in the installation portion 13, the end portion Pse of the plurality of sheets of paper P accommodated in the cassette 11 is aligned by the restriction unit 100. Thereafter, a sheet of paper P fed to the U-shaped inverse path 50 by the pickup roller 16 passes through the U-shaped inverse path 50 due to the transporting and guiding action of the separation roller 21 and the intermediate transport rollers 25 and 31 and is fed to the transport roller 34 provided at the position near the downstream of the U-shaped inverse path 50.

At the downstream side of the transport path of the paper P of the transport roller 34, the supporting member 38 and the recording head 42 are so disposed that they face each other in the vertical direction in the vertical direction D3. When the paper P is fed on the supporting member 38 by the rotation of the driving transport roller 35 and transported to the position facing the recording head 42, the recording head 42 performs recording on the paper P. The paper P finished with the recording is sent to the discharge stacker 46 by the discharge roller 43.

Figure 2:
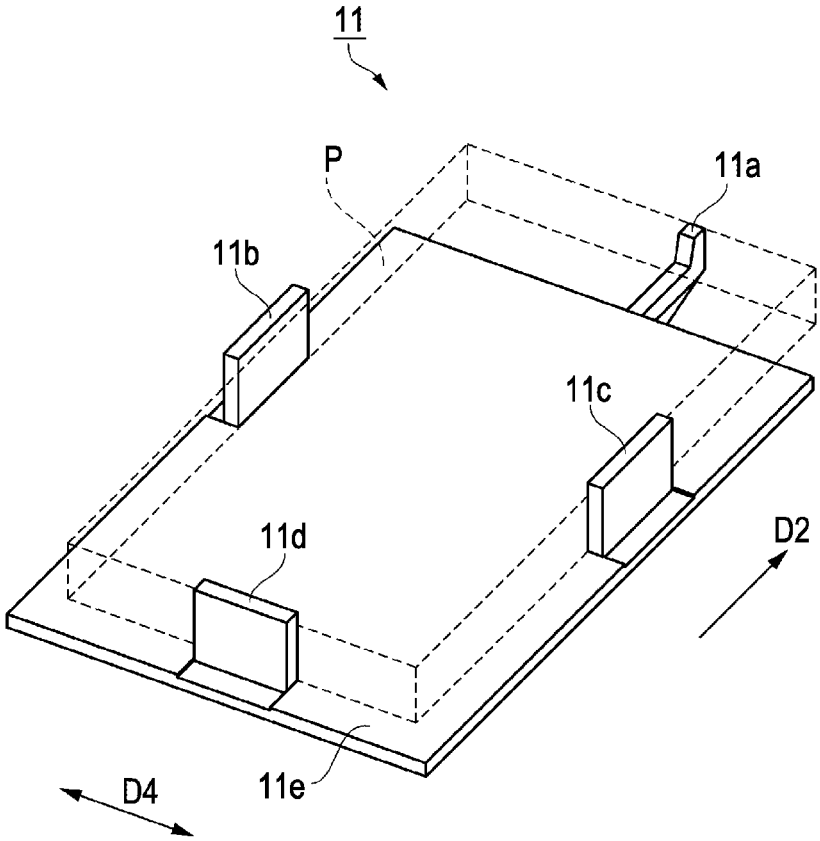
FIG. 2 is an exterior perspective view of a cassette in which a plurality of sheets of papers are stacked and accommodated.

FIG. 2 is an exterior perspective view of a cassette 11 in which a plurality of sheets of papers P are stacked and accommodated. A cassette body 11*e* of the cassette 11 is provided with width direction edge guides 11*b* and 11*c* restricting the width direction D4 of the paper P. Since the width direction edge guides 11*b* and 11*c* can slide in the width direction D4, they can restrict the width direction D4 of the paper P according to the width of the paper P loaded in the cassette 11.

Furthermore, the cassette body 11*e* of the cassette 11 is provided with a rear end edge guide 11*d* restricting the opposite side to the separation slope 12 in FIG. 1 in the installation direction D2 of the paper P. Since the rear end edge guide 11*d* can slide in the installation direction D2, it can restrict the opposite side to the separation slope 12 in the installation direction D2 of the paper P according to the length of the paper P loaded in the cassette 11 in the installation direction D2.

At the side of the separation slope 12 in FIG. 1 in the installation direction D2 of the cassette body 11*e*, a protruding portion 11*a* is provided.

Figure 3:
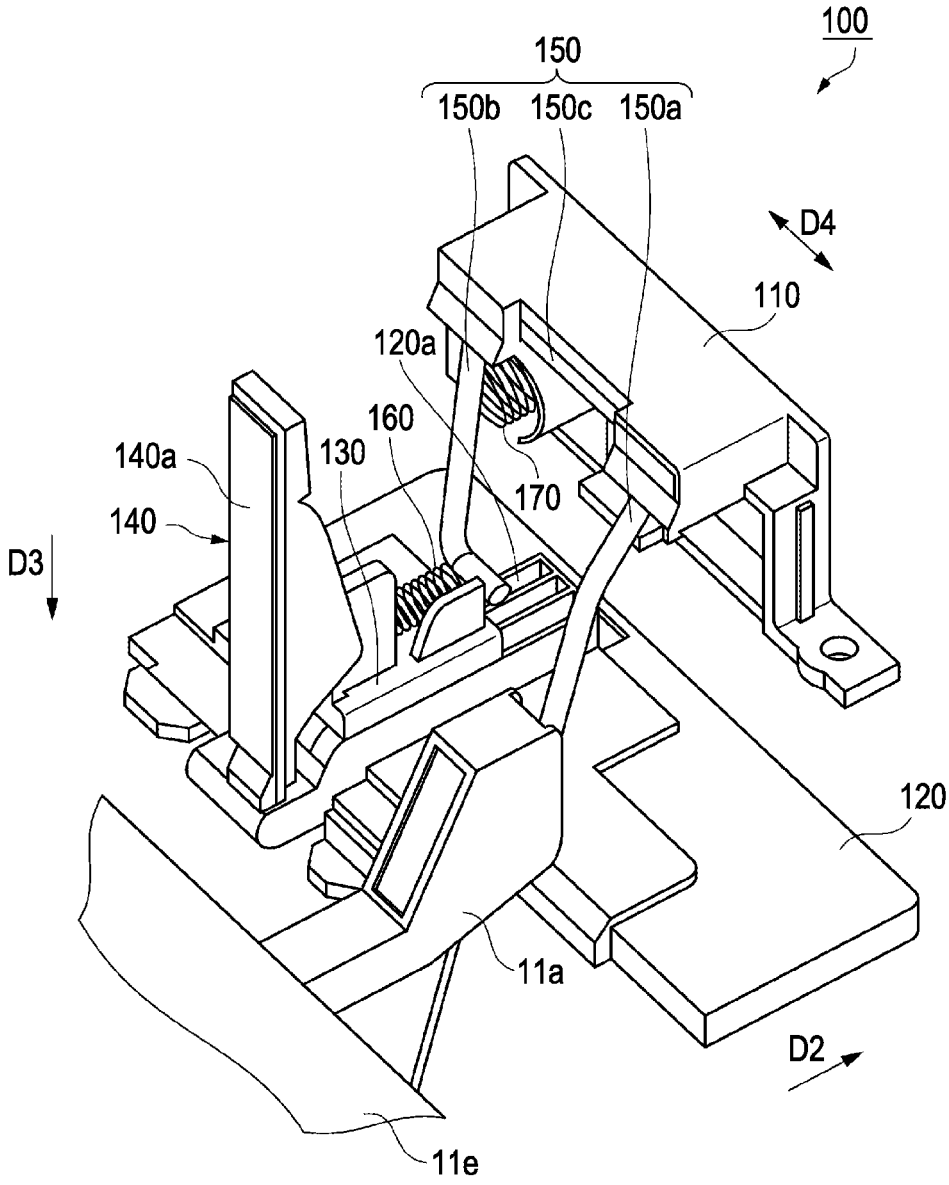
FIG. 3 is an exterior perspective view of a restriction unit.

FIG. 3 is an exterior perspective view of the restriction unit 100 in FIG. 1. The unit frame 81 in FIG. 1 is provided with a lever receiving portion 110 and a base 120. The lever receiving portion 110 supports a lever 150. The lever 150 includes a first lever 150*a*, a second lever 150*b* and a shaft portion 150*c*. The shaft portion 150*c* connects the first lever 150*a* and the second lever 150*b*.

The base 120 is provided with a slider 130. The slider 130 slides in the installation direction D2 along a groove portion 120*a* of the base 120. A coil spring 160 as an elastic member connects the slider 130 and the second lever 150*b*.

A stopper 140 as a restriction member having a restriction surface 140*a* is link-connected to the slider 130 and the base 120.

When the user pushes the cassette 11 in the installation direction D2, the protruding portion 11*a* provided in the cassette body 11*e* abuts on the first lever 150*a*.

Figure 4:
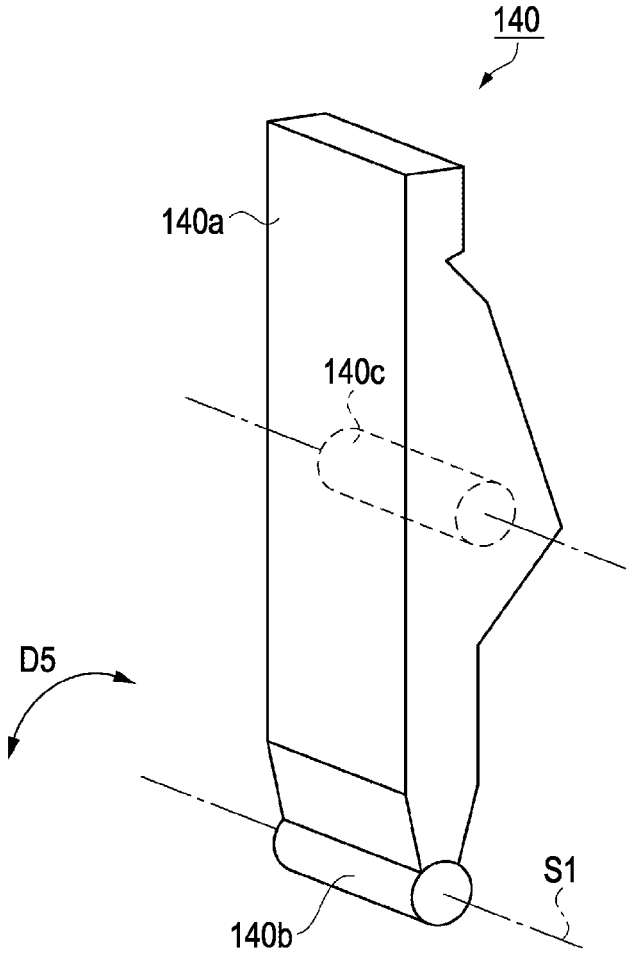
FIG. 4 is an exterior perspective view of a stopper as a restriction member.

FIG. 4 is an exterior perspective view of the stopper 140 as the restriction member. The restriction surface 140*a* of the stopper 140 restricts the movement of the end portion Pse of the paper P in FIG. 1 in the installation direction D2.

At the bottom of the vertical direction D3 of the stopper 140, there is formed a cylinder portion 140*b*. The base 120 and the stopper 140 are link-connected to each other through the cylinder portion 140*b*. The stopper 140 rotates on a rotation axis S1 of the cylinder portion 140*b* as the rotation center in rotation direction D5.

In the stopper 140, a cylinder portion 140*c* is formed at the opposite side to the restriction surface 140*a*.

Figure 5:
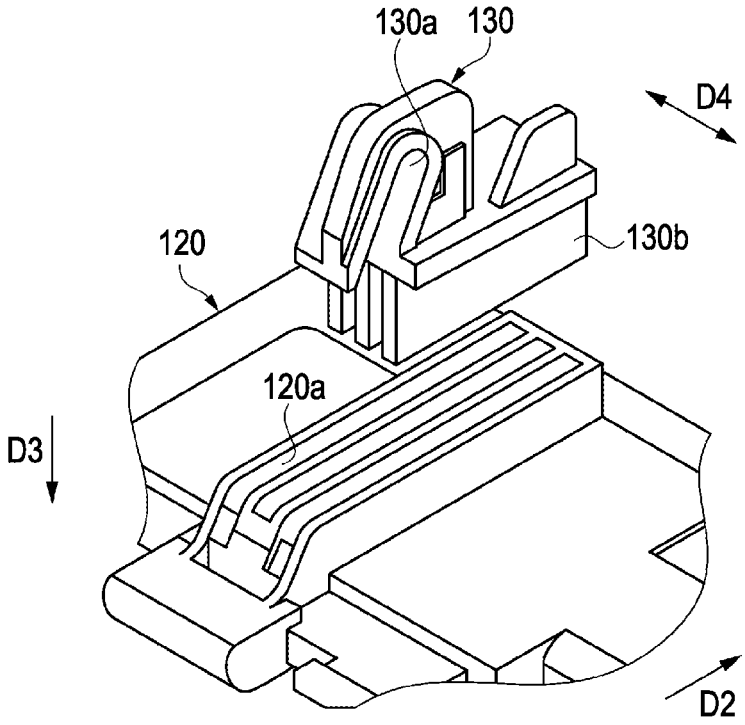
FIG. 5 is an exterior perspective view of a base and a slider.

FIG. 5 is an exterior perspective view of the base 120 and the slider 130. In FIG. 5, the base 120 and the slider 130 are positioned separately in the vertical direction D3 for the purpose of description.

The slider 130 in FIG. 5 is provided with a receiving portion 130*a* in which a groove portion extending in a direction inclined to the vertical direction D3 is formed. The groove portion of the receiving portion 130*a* penetrates the width direction D4 of the paper P, and the lower side thereof in the vertical direction D3 is opened. Since the width of the groove portion is longer than the diameter of the cylinder portion 140*c* of the stopper 140 in FIG. 4, the cylinder portion 140*c* can enter the groove portion of the receiving portion 130*a*. As a result, the slider 130 and the stopper 140 are link-connected to each other.

In the base 120 in FIG. 5, there is formed a plurality of groove portions 120*a* extending in the installation direction D2. In the slider 130, there is formed a plurality of protruding portions 130*b*. The groove portions 120*a* and the protruding portions 130*b* are so disposed that the protruding portions 130*b* can move along the installation direction D2 by being guided by the groove portions 120*a*. Accordingly, the slider 130 moves in the installation direction D2.

The cylinder portion 140*c* can slide along the groove portions of the receiving portions 130*a*. As described above, the groove portions of the receiving portions 130*a* are formed so as to extend in a direction inclined to the vertical direction D3. Therefore, when the slider 130 moves in the installation direction D2, the cylinder portion 140*c* receives the force in the installation direction D2, so the cylinder portion 140*c* moves in the installation direction D2; also the cylinder portion 140*c* moves in the vertical direction D3 due to the component of the force in the vertical direction D3. Accordingly, the stopper 140 rotates on the rotation axis S1 as a rotation center of the cylinder portion 140*b* in the rotation direction D5.

On the contact surface between the slider 130 and the base 120, there is disposed a viscous material (not shown). Therefore, the contact surface between the slider 130 and the base 120 functions as an oil damper.

Figure 6:
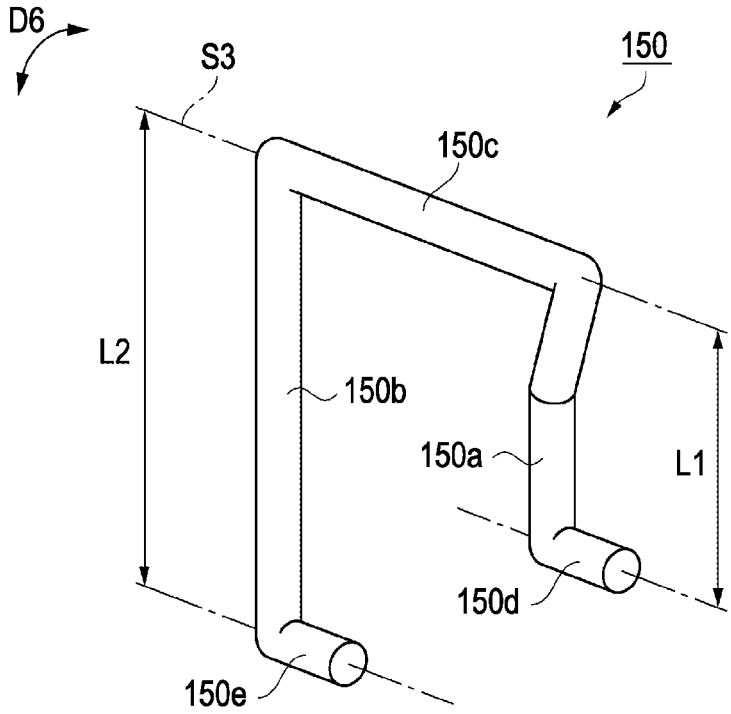
FIG. 6 is an exterior perspective view of a lever as the transmission member.

FIG. 6 is an exterior perspective view of a lever 150 as the transmission member. The range of the first lever 150*a* is from an abutting portion 150*d* to a rotation axis S3 of a shaft portion 150*c*, and the range of the second lever 150*b* is from a connection portion 150*e* to the rotation axis S3 of the shaft portion 150*c*.

A distance L1 from the abutting portion 150*d* to the rotation axis S3 of the shaft portion 150*c* in the first lever 150*a* is shorter than a distance L2 from the connection portion 150*e* to the rotation axis S3 of the shaft portion 150*c* in the second lever 150*b*.

The shaft portion 150*c* in FIG. 6 is rotatably supported by the lever receiving portion 110 in FIG. 3 provided to the unit frame 81 in FIG. 1. The first lever 150*a* and the second lever 150*b* rotate on the rotation axis S3 as a rotation center in a rotation direction D6.

When the cassette 11 in FIG. 1 moves in the installation direction D2 along the installation portion 13, the protruding portion 11*a* (see FIG. 2) of the cassette 11 in FIG. 3 abuts on the abutting portion 150*d* (see FIG. 6) of the first lever 150*a*, and the abutting portion 150*d* moves to the installation portion 13 side in the installation direction D2. As a result, the lever 150 rotates on the rotation axis S3 as a rotation center.

Accordingly, the connection portion 150*e* of the second lever 150*b* moves to the installation portion 13 side in the installation direction D2. Also, the coil spring 160 connected to the connection portion 150*e* is pulled to the installation portion 13 side in the installation direction D2. As a result, the slider 130 connected to the coil spring 160 slides in the installation direction D2, hence the stopper 140 is inclined.

In the embodiment, the damper mechanism portion includes a first damper portion having the slider 130, groove portions 120*a* formed in the base 120 and the viscous material, and a second damper portion having the coil spring 160.

The damper mechanism portion absorbs the acting force which is generated by pulling of the connection portion 150*e* of the second lever 150*b* in the installation direction D2 in response to the rotation of the lever 150 and which rotates the stopper 140. As a result, it is possible to slow down the rotation of the stopper 140 or to delay the point of time when the stopper 140 starts to rotate and incline.

A coil spring 170 is provided in the lever receiving portion 110 and abuts on the second lever 150*b*. The coil spring 170 transmits the force, which acts to rotate the lever 150 in the opposite direction to the direction in which the lever 150 rotates due to the movement of the cassette 11 in the installation direction D2, to the second lever 150*b*.

While the cassette 11 does not abut on the abutting portion 150*d* of the first lever 150*a*, the slider 130 is positioned at the opposite side to the installation portion 13 in the installation direction D2 by the action of the coil spring 170, and the surface direction of the restriction surface 140*a* of the stopper 140 is disposed in the vertical direction D3, as shown in FIG. 3.

Figure 7A:
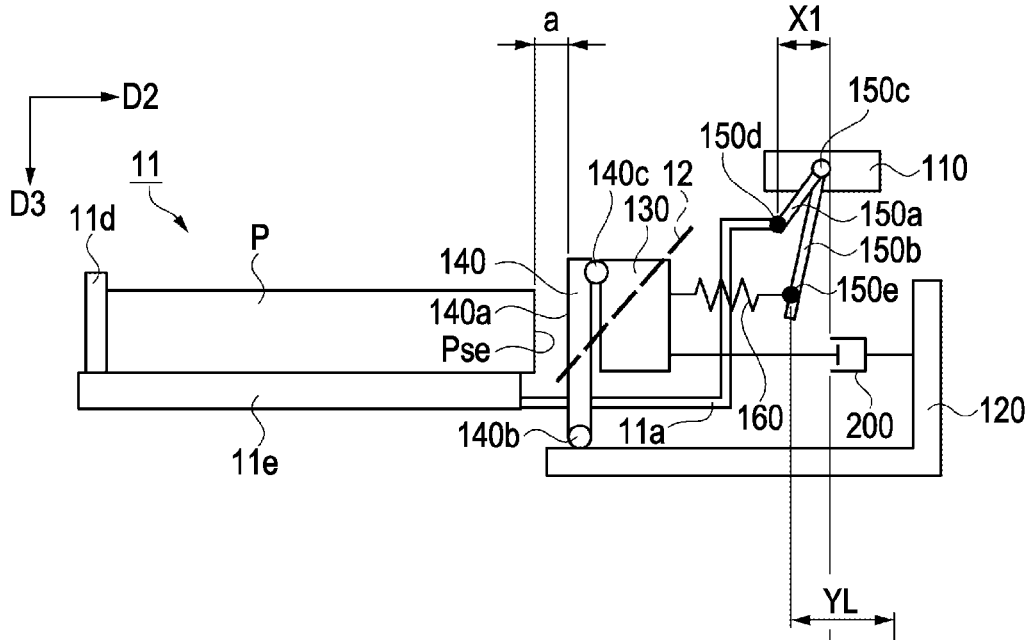
FIGS. 7A and 7B are schematic views for describing a state where the stopper inclines due to the movement of the cassette.
Figure 7B:
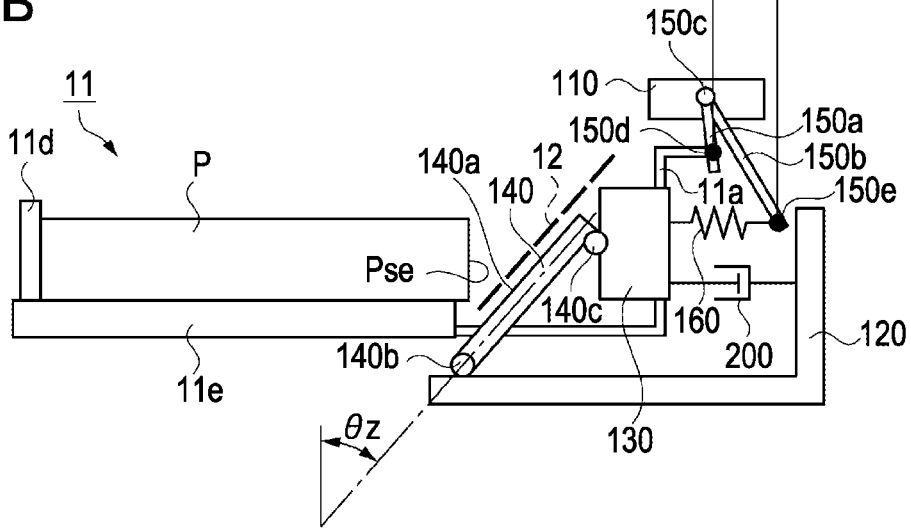

FIGS. 7A and 7B are schematic views for describing a state where the stopper 140 inclines due to the movement of the cassette 11. FIG. 7A is a view for describing a state of an abutment starting time point where the cassette 11 moves in the installation direction D2 and the protruding portion 11*a* of the cassette 11 starts to abut on the abutting portion 150*d* of the first lever 150*a*.

At the abutment starting time point in FIG. 7A, the surface direction of the restriction surface 140*a* of the stopper 140 is positioned in the direction crossing the separation slope 12 (a bold broken line) as a slope. As a result, the end portion Pse of the paper P abuts on the restriction surface 140*a*, whereby the movement of the paper P in the installation direction D2 is restricted.

At the abutment starting time point in FIG. 7A, the end portion Pse of the paper P is positioned at the position separated from the restriction surface 140*a* by a gap distance a. As a result, the paper P is inhibited from being damaged by bending or the like resulting from a state where the paper P is interposed between the rear end edge guide 11*d* and the restriction surface 140*a* of the stopper 140 when the cassette 11 moves further in the installation direction D2.

FIG. 7B is a view describing a state at a retraction time point where the cassette 11 moves further in the installation direction D2, and the stopper 140 retreats to the downstream side in the installation direction D2 of the separation slope 12. At the retraction time point in FIG. 7B, the stopper 140 inclines with respect to the vertical direction D3 by an inclination angle θz, and the surface direction of the restriction surface 140*a* of the stopper 140 is positioned in the surface direction of the separation slope 12 (a bold broken line) as a slope. Also, the restriction surface 140*a* is positioned at the downstream side in the installation direction D2 of the separation slope 12. Accordingly, since the end portion Pse of the paper P does not abut on the restriction surface 140*a*, the restriction on the movement of the paper P in the installation direction D2 has been released.

When the user pushes the cassette 11 in the installation direction D2 by a movement amount X1, the position of the abutting portion 150*d* in the first lever 150*a* abutting on the protruding portion 11*a* of the cassette 11 moves to the position in the retraction time point in FIG. 7B from the position in the abutment starting time point in FIG. 7A by the movement amount X1 in the installation direction D2.

Then the lever 150 rotates, and the position of the connection portion 150*e* in the second lever 150*b* connected to the coil spring 160 moves to the position in the retraction time point in FIG. 7B from the position in the abutment starting time point in FIG. 7A by a movement amount YL in the installation direction D2.

As shown in FIG. 6, provided that a distance from the rotation axis S3 to the connection portion 150*e* in the second lever 150*b* is L2 and that a distance from the rotation axis S3 to the abutting portion 150*d* in the first lever 150*a* is L1, a lever ratio LX can be calculated by the following formula (1).

$$LX=L2/L1 \quad (1)$$

The first lever 150*a* and the second lever 150*b* rotate on the rotation axis S3 as a pivot; therefore, a movement amount YL of the connection portion 150*e* in the installation direction D2 in FIGS. 7A and 7B can be calculated through the following formula (2) by using the movement amount X1 of the connection portion 150*d* in the installation direction D2 and the lever ratio LX in formula (1).

$$YL=X1\times LX \quad (2)$$

The distance L2 from the rotation axis S3 to the connection portion 150*e* in the second lever 150*b* is longer than the distance L1 from the rotation axis S3 to the abutting portion 150*d* in the first lever 150*a*. Accordingly, since the value of the lever ratio LX in the formula (1) exceeds 1, the movement amount YL of the connection portion 150*e* in the installation direction D2 in FIGS. 7A and 7B is longer than the movement amount X1 of the abutting portion 150*d* in the installation direction D2. In this manner, the movement amount YL of the connection portion 150*e* in the installation direction D2 is obtained as a value in which the movement amount X1 of the abutting portion 150*d* in the installation direction D2 is amplified by the lever ratio LX.

A first damper portion 200 in FIGS. 7A and 7B includes the base 120, the slider 130 sliding with respect to the base 120 and the viscous material in FIG. 5. By using the first damper portion 200, it is possible to slow down the rotation of the stopper 140 when the cassette 11 moves in the installation direction D2. Alternatively, it is possible to delay the time from the point of time when the protruding portion 11*a* of the cassette 11 abuts on the abutting portion 150*d* of the first lever 150*a* to the start of the movement of the slider 130 in the installation direction D2. As a result, it is possible to delay the point of time when the stopper 140 starts to rotate.

Figure 8:
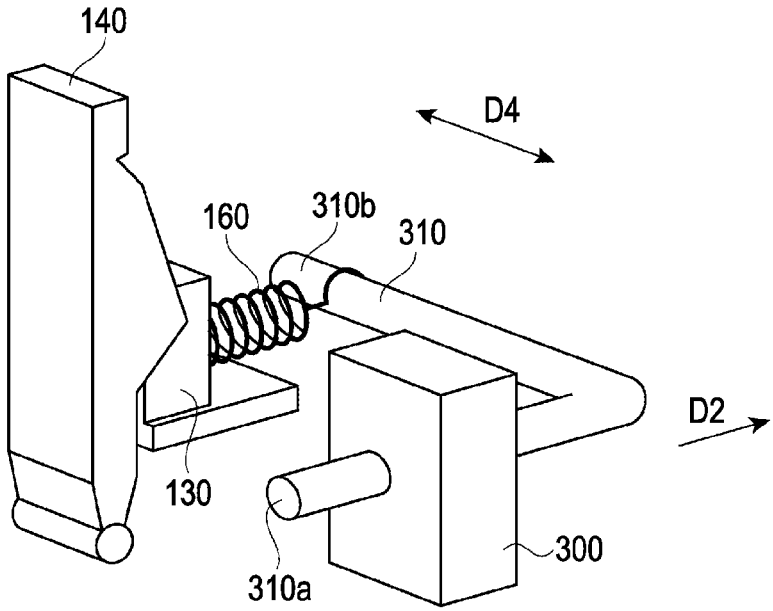
FIG. 8 is an exterior perspective view of the restriction unit in a comparative example.

FIG. 8 is an exterior perspective view of the restriction unit in a comparative example compared to the embodiment. The restriction unit in the comparative example includes an L-shaped member 310 and a supporting portion 300 movably supporting the L-shaped member 310 in the installation direction D2.

When the cassette 11 moves in the installation direction D2, the protruding portion 11*a* of the cassette 11 abuts on an abutting portion 310*a* of the L-shaped member 310. Then the coil spring 160 connected to a connection portion 310*b* of the L-shaped member 310 is pulled in the installation direction D2.

Figure 9A:
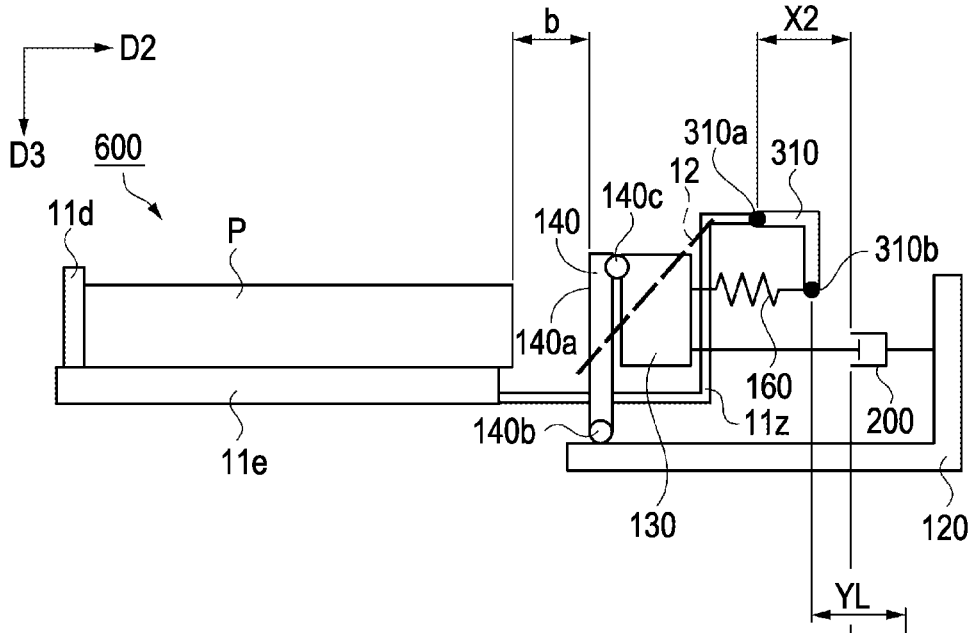
FIGS. 9A and 9B are schematic views for describing a state where the stopper inclines due to the movement of the cassette in the comparative example.
Figure 9B:
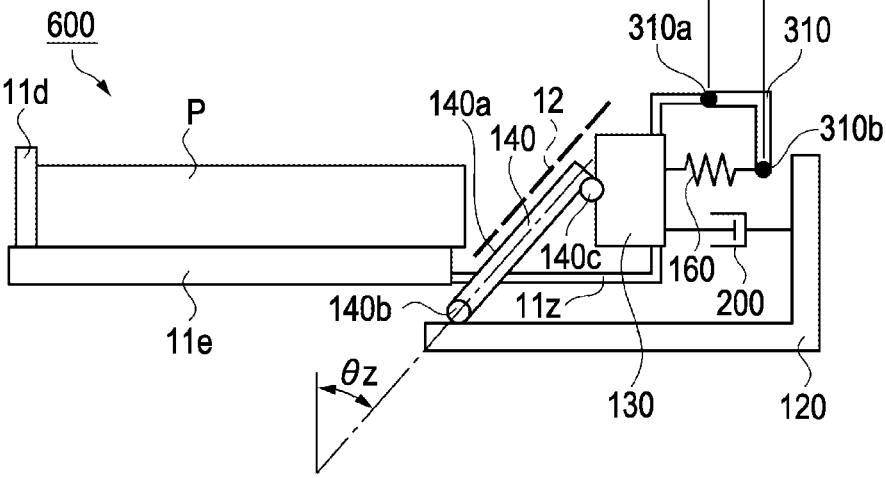

FIGS. 9A and 9B are schematic views for describing a state where the stopper 140 inclines due to the movement of a cassette 600 in a comparative example using the restriction unit in FIG. 8. FIG. 9A is a view describing a state of an abutment starting time point where the cassette 600 moves in the installation direction D2, and a protruding portion 11*z* of the cassette 600 starts to abut on the abutting portion 310*a* of the L-shaped member 310 in FIG. 8.

FIG. 9B is a view describing a state at a retraction time point where the cassette 600 moves further in the installation direction D2, and the stopper 140 retreats to the downstream side in the installation direction D2 of the separation slope 12. At the retraction time point in FIG. 9B, the stopper 140 inclines with respect to the vertical direction D3 by an inclination angle θz, and the surface direction of the restriction surface 140*a* of the stopper 140 is positioned in the surface direction of the separation slope 12 (a bold broken line) as a slope. Also, the restriction surface 140*a* is positioned at the downstream side in the installation direction D2 of the separation slope 12. Accordingly, since the end portion Pse of the paper P does not abut on the restriction surface 140*a*, the restriction on the movement of the paper P in the installation direction D2 has been released.

In the comparative example, the movement amount YL of the connection portion 310*b* in the installation direction D2 is the same as the movement amount X2 of the abutting portion 310*a* in the installation direction D2.

At the abutment starting time point in FIG. 9A, the end portion Pse of the paper P is positioned at the position separated from the restriction surface 140*a* by a gap distance b. As a result, the paper P is inhibited from being damaged by bending or the like resulting from a state where the paper P is interposed between the rear end edge guide 11*d* and the restriction surface 140*a* of the stopper 140 when the cassette 600 moves further in the installation direction D2.

Figure 10A:
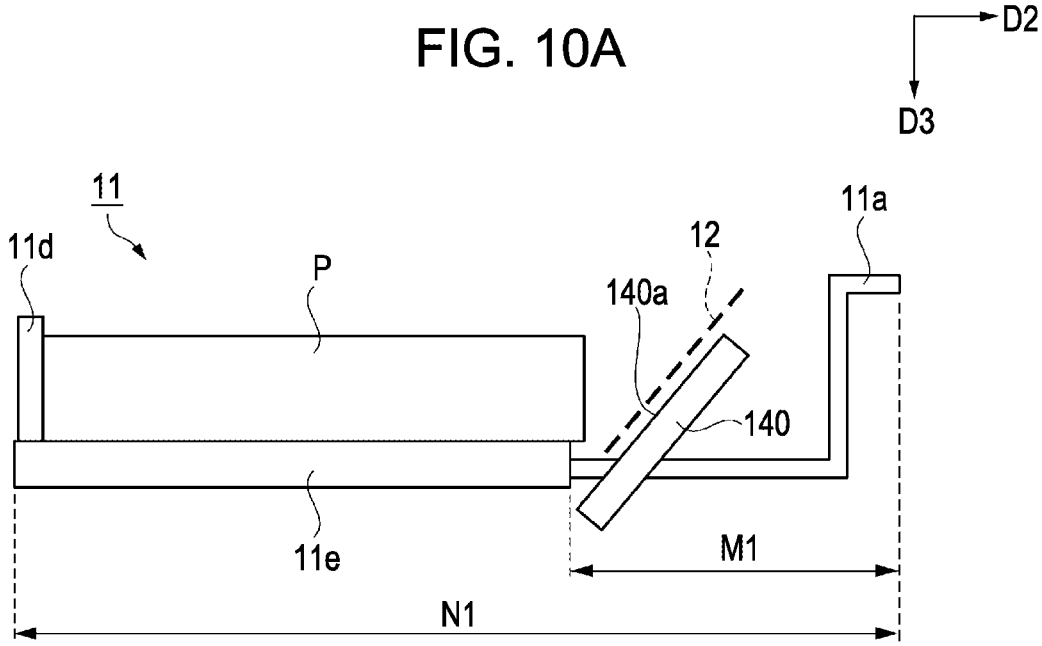
FIGS. 10A and 10B are schematic views comparing the length of a protruding portion in the present embodiment to the length of a protruding portion in the comparative example.
Figure 10B:
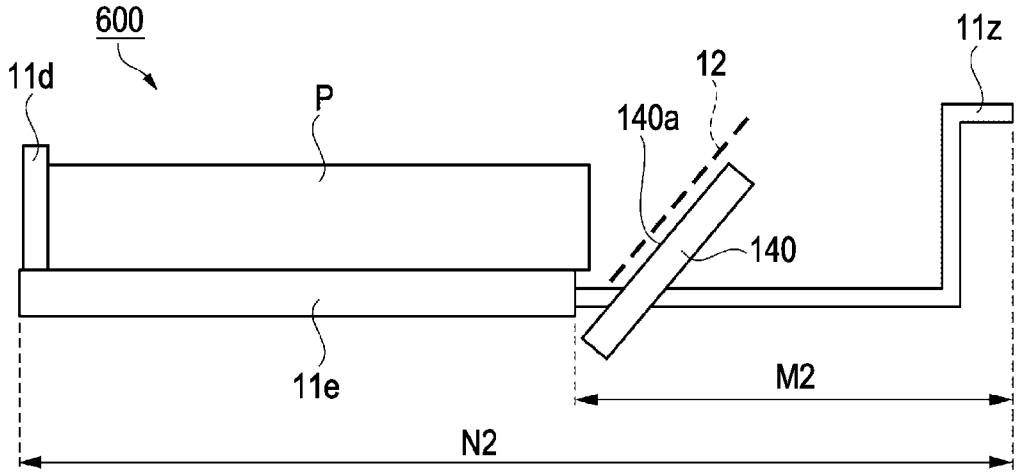

FIGS. 10A and 10B are schematic views for comparing the length of the cassette 11 in the installation direction D2 of the present embodiment to the length of the cassette 600 in the installation direction D2 of the comparative example. FIG. 10A shows the retraction time point when the cassette 11 in the embodiment in FIG. 7B moves in the installation direction D2, and the stopper 140 retreats to the downstream side in the installation direction D2 of the separation slope 12 and is a schematic view at a point of time when the cassette 11 is installed in the installation portion 13 in FIG. 1. FIG. 10A shows the cassette body 11*e*, the rear end edge guide 11*d*, the separation slope 12, the stopper 140 and the protruding portion 11*a*; however, other components are not shown in this drawing.

Likewise, FIG. 10B shows the retraction time point when the cassette 600 in the comparative example in FIG. 9B moves in the installation direction D2, and the stopper 140 retreats to the downstream side in the installation direction D2 of the separation slope 12 and is a schematic view at a point of time when the cassette 600 is installed in the installation portion 13 in FIG. 1. FIG. 10B shows the cassette body 11*e*, the rear end edge guide 11*d*, the separation slope 12, the stopper 140 and the protruding portion 11*z*; however, other components are not shown in this drawing.

The position of the end face to the separation slope 12 side in the installation direction D2 of the cassette body 11*e* of the cassette 11 of the embodiment in FIG. 10A is determined by the distance between the separation slope 12 and the end face. Therefore, this position is the same as the position of the end face at the separation slope 12 side in the installation direction D2 of the cassette body 11*e* of the cassette 600 of the comparative example in FIG. 10B.

The position of the end face in the installation direction D2 to the separation slope 12 side in the protruding portion 11*a* of the embodiment in FIG. 10A becomes the position of the abutting portion 150*d* of the first lever 150*a* in FIG. 7B. Accordingly, a length M1 of the protruding portion 11*a* in the installation direction D2 is determined by the movement amount X1 of the abutting portion 150*d* in FIGS. 7A and 7B.

The position of the end face to the separation slope 12 side in the protruding portion 11*z* of the comparative example in FIG. 10B becomes the position of the abutting portion 310*a* of the L-shaped member 310 in FIG. 9B. Accordingly, a length M2 of the protruding portion 11*z* in the installation direction D2 is determined by the movement amount X2 of the abutting portion 310*a* in FIGS. 9A and 9B.

As described above, the movement amount X1 of the abutting portion 150*d* in FIGS. 7A and 7B can be made shorter than the movement amount X2 of the abutting portion 310*a* in FIGS. 9A and 9B. Accordingly, the length M1 of the protruding portion 11*a* in the installation direction D2 of the embodiment is shorter than the length M2 of the protruding portion 11*z* in the installation direction D2 of the comparative example.

The cassette body 11*e* of the cassette 11 of the embodiment has the same configuration as the cassette body 11*e* of the cassette 600 of the comparative example, and the length thereof in the installation direction D2 is the same. Therefore, a length N1 of the cassette 11 in the installation direction D2 in the embodiment is shorter than a length N2 of the cassette 600 in the installation direction D2 in the comparative example.

As described above, the loading device 10 described in the embodiment includes a cassette 11 which has the protruding portion 11*a* protruding in the installation direction D2 and stacks and accommodates the paper P as a plurality of recording media; the installation portion 13 in which the cassette 11 is installed when the cassette 11 moves in the installation direction D2; the lever 150 as the transmission member which has the shaft portion 150*c*, the abutting portion 150*d* and connection portion 150*e*, wherein the distance L1 from the rotation axis S3 of the shaft portion 150*c* to the abutting portion 150*d* is shorter than the distance L2 from the rotation axis S3 of the shaft portion 150*c* to the connection portion 150*e*, the transmission member transmitting a force that the abutting portion 150*d* receives from the cassette 11 to the connection portion 150*e* as an acting force by rotating on the rotation axis S3 of the shaft portion 150*c* as the axis when the protruding portion 11*a* of the cassette 11 abuts on the abutting portion 150*d* due to the movement of the cassette 11 in the installation direction D2; the damper mechanism portion connected to the connection portion 150*e* in the lever 150 and receiving the acting force from the connection portion 150*e*; the separation slope 12 positioned at the downstream side in the installation direction D2 of the cassette 11 and separating the paper P; and the stopper 140 as the restriction member connected to the damper mechanism portion, restricting the movement of the paper P at the upstream side position in the installation direction D2 of the separation slope 12, and releasing the restriction on the movement of the paper P by retreating from the position where the stopper 140 restricts the paper P when receiving the acting force from the damper mechanism portion.

With this configuration, it is possible to make the movement distance X1 of the abutting portion 150*d* shorter than the movement distance YL of the connection portion 150*e* in the installation direction D2. Accordingly, the position of the abutting portion 150*d* abutting the protruding portion 11*a* of the cassette 11 at the point of time when the stopper 140 retreats from the position at the upstream side of the separation slope 12 to release the restriction on the movement of the paper P can be made close to the cassette body 11*e* in the installation direction D2. As a result, since the length M1 of the protruding portion 11*a* in the installation direction D2 can be shortened, the length N1 of the entire cassette 11 including the cassette body 11*e* and the protruding portion 11*a* in the installation direction D2 can be made short, hence the loading device 10 can be made small.

Furthermore, the lever 150 as the transmission member includes the first lever 150*a* and the second lever 150*b*. According to this configuration, since the loading device can be configured with one member, the increase in production cost can be inhibited.

Figure 11:
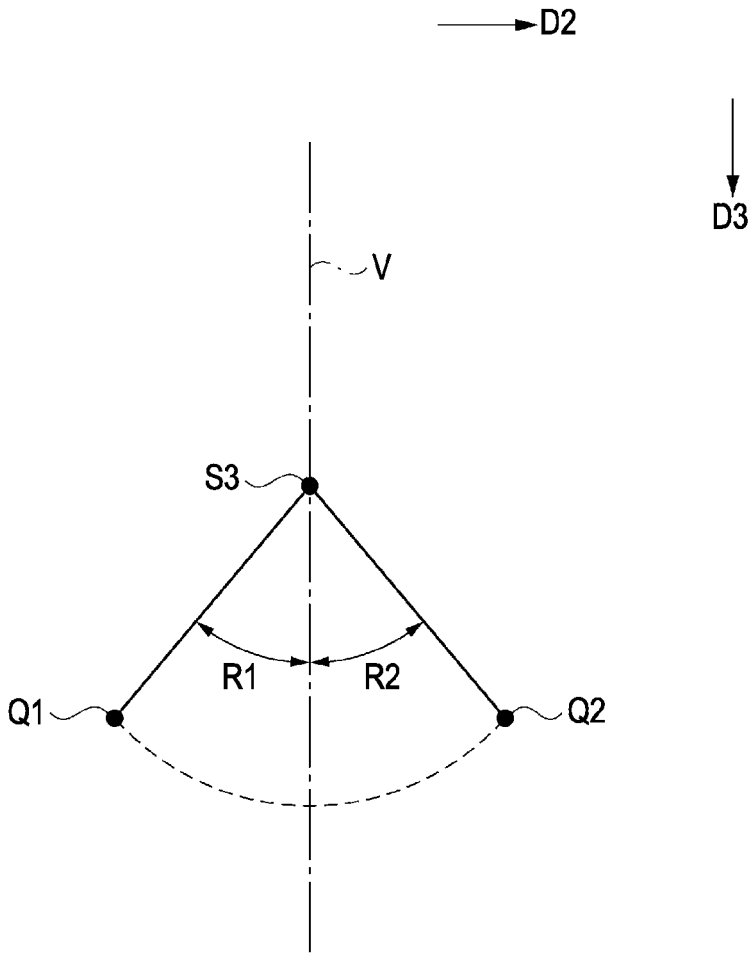
FIG. 11 is a view for describing a positional range of the rotation angle by which an abutting portion and a connection portion rotate.

FIG. 11 is a view for describing a positional range of the rotation angle by which the abutting portion 150*d* rotates. In FIG. 11, Q1 and Q2 indicate the movement starting position and the movement ending position of the abutting portion 150*d* respectively.

Furthermore, when the cassette 11 moves in the installation direction D2 while abutting on the abutting portion 150*d*, the respective positional range (angular range including the movement starting position Q1 and the movement ending position Q2 with the rotation axis S3 as a vertex) of the rotation angle on the rotation axis S3 as a center in the abutting portion 150*d* may include a vertical line V passing the rotation axis S3.

The effect achieved by including the vertical line V passing the rotation axis S3 in the positional range of the rotation angle on the rotation axis S3 as a center in the abutting portion 150*d* will be described.

Figure 14A:
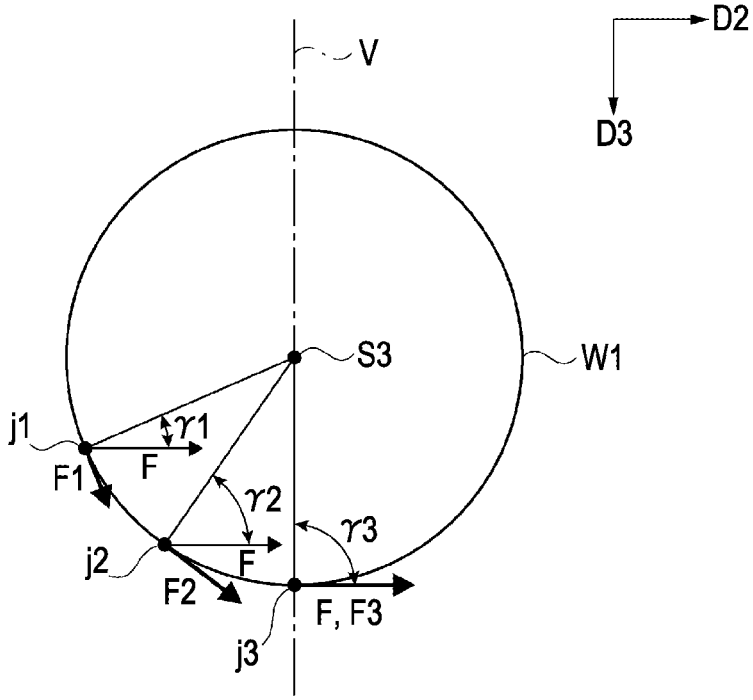
FIG. 14A is a view showing a force in a tangential direction received from the cassette in the position of the abutting member.

FIG. 14A is a view showing forces F1 to F3 in a tangential direction received from the cassette 11 in positions j1 to j3 of the abutting portion 150*d*. A circle W1 shows a movement trajectory at the time when the abutting portion 150*d* rotates on the rotation axis S3 as a center. When the protruding portion 11*a* of the cassette 11 moves in the installation direction D2 while abutting on the abutting portion 150*d*, the abutting portion 150*d* moves to the positions j1 to j3 in the movement trajectory W1.

A force in the installation direction D2 that the abutting portion 150*d* in the positions j1 to j3 receives from the cassette 11 is F. The angles of a line connecting the rotation axis S3 and the abutting portion 150*d* with respect to the installation direction D2 are angles γ1, γ2 and γ3 at the positions j1, j2 and j3 of the abutting portion 150*d* respectively. The position j3 of the abutting portion 150*d* is the position of the vertical line V, and the angle γ3 is a right angle.

Accordingly, the force in the tangential direction of the movement trajectory W1, which is received by the abutting portion 150*d* in the positions j1 to j3 from the cassette 11 is represented by the following formulae (3) to (5).

$$F1=F\cdot\mathrm{Sin}(\gamma 1) \quad (3)$$

$$F2=F\cdot\mathrm{Sin}(\gamma 2) \quad (4)$$

$$F3=F\cdot\mathrm{Sin}(\gamma 3) \quad (5)$$

The angle γ3 in the position j3 of the abutting portion 150*d* is a right angle; therefore, the force F3 in the tangential direction is equal to the force F in the installation direction D2 received from the cassette 11.

The angle γ3 is larger than the angle γ2, and the angle γ2 is larger than the angle γ1. Accordingly, the force F3 in the tangential direction at the position j3 is larger than the force F2 in the tangential direction at the position j2, and the force F2 in the tangential direction at the position j2 is larger than the force F1 in the tangential direction at the position j1. In other words, as the position of the abutting portion 150*d* in the movement trajectory W1 gets closer to the vertical line V, the force in the tangential direction increases.

Hence, by including the vertical line V passing the rotation axis S3 in the positional range of the rotation angle on the rotation axis S3 as a center in the abutting portion 150*d*, it is possible to efficiently rotate the lever 150.

Furthermore, the vertical line V is positioned at the center of the positional range (angular range including the movement starting position Q1 and the movement ending position Q2 with the rotation axis S3 as a vertex) of the rotation angle of the abutting portion 150*d* in FIG. 11. That is, a rotation angle R1 including the movement starting position Q1 and the vertical line V with the rotation axis S3 as a vertex may be equal to a rotation angle R2 including the movement ending position Q2 and the vertical line V with the rotation axis S3 as a vertex.

According to this configuration, it is possible to more efficiently rotate the lever 150.

Next, the positional range of the rotation angle on the rotation axis S3 as a center in the connection portion 150*e* will be described by using FIG. 13. Herein, Q1 and Q2 in FIG. 11 represent the movement starting position and the movement ending position of the connection portion 150*e* respectively.

When the cassette 11 moves in the installation direction D2 while abutting on the abutting portion 150*d*, the respective positional range (angular range including the movement starting position Q1 and the movement ending position Q2 with the rotation axis S3 as a vertex) of the rotation angle on the rotation axis S3 as a center in the connection portion 150*e* may include a vertical line V passing the rotation axis S3.

Next, the effect achieved by including the vertical line V passing the rotation axis S3 in the positional range of the rotation angle on the rotation axis S3 as a center in the connection portion 150*e* will be described.

Figure 14B:
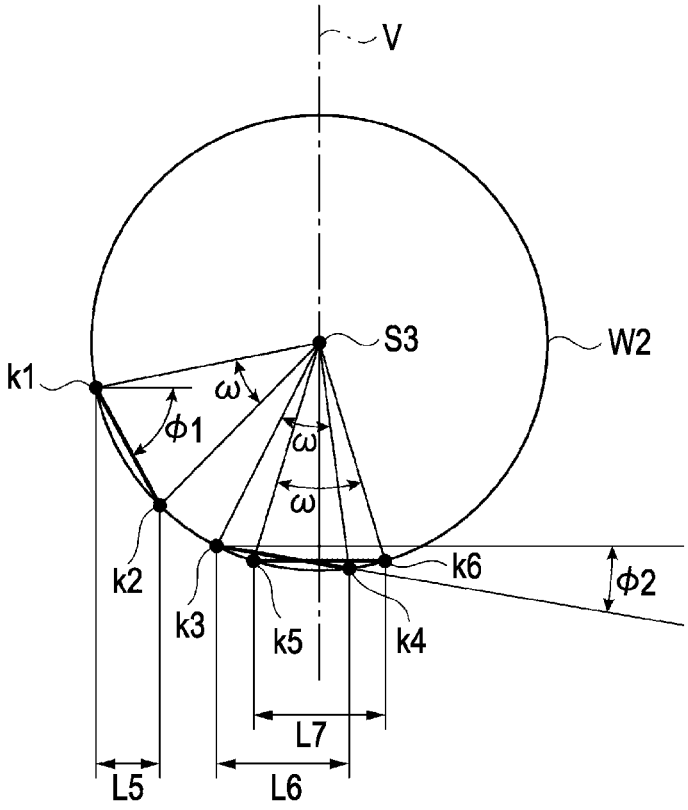
FIG. 14B is a view showing the movement distance in the installation direction in positional range of the rotation angle on the rotation axis as a center in the connection portion.

FIG. 14B is a view showing the movement distance in the installation direction D2 in the positional range of the rotation angle ω around the rotation axis S3 as a center in the connection portion 150*e*. From a movement starting position k1 to the movement ending position k2 in the positional range of the rotation angle ω, it is shown that the vertical line V passing the rotation axis S3 is not included therein.

From a movement starting position k3 to the movement ending position k4 in the positional range of the rotation angle, it is shown that the vertical line V passing the rotation axis S3 is included therein.

An angle φ2 of a line connecting the movement starting position k3 to the movement ending position k4 with respect to the installation direction D2 is smaller than an angle φ1 of a line connecting the movement starting position k1 to the movement ending position k2 with respect to the installation direction D2. Therefore, a distance L6 from the movement starting position k3 to the movement ending position k4 in the installation direction D2 is longer than a distance L5 from the movement starting position k1 to the movement ending position k2 in the installation direction D2.

That is, by including the vertical line V passing the rotation axis S3 in the positional range of the rotation angle ω on the rotation axis S3 as a center in the connection portion 150*e*, it is possible to elongate the distance in the installation direction D2 of the connection portion 150*e*.

Furthermore, the vertical line V may be positioned at the center of the positional range (angular range including the movement starting position Q1 and the movement ending position Q2 with the rotation axis S3 as a vertex) of the rotation angle of the connection portion 150*e* in FIG. 11. That is, a rotation angle R1 including the movement starting position Q1 and the vertical line V with the rotation axis S3 as a vertex may be equal to a rotation angle R2 including the movement ending position Q2 and the vertical line V with the rotation axis S3 as a vertex.

A movement starting position k5 and a movement ending position k6 of the connection portion 150*e* in FIG. 14B show that the connection portion 150*e* is rotated so that the vertical line V is positioned at the center of the positional range of the rotation angle ω of the connection portion 150*e* in FIG. 14B. In this manner, the direction of the line connecting the movement starting position k5 to the movement ending position k6 coincides with the installation direction D2; therefore, it is possible to create a distance L7 which is longer than the distance L6 in the installation direction D2 of the connection portion 150*e*.

Second Embodiment

Figure 12:
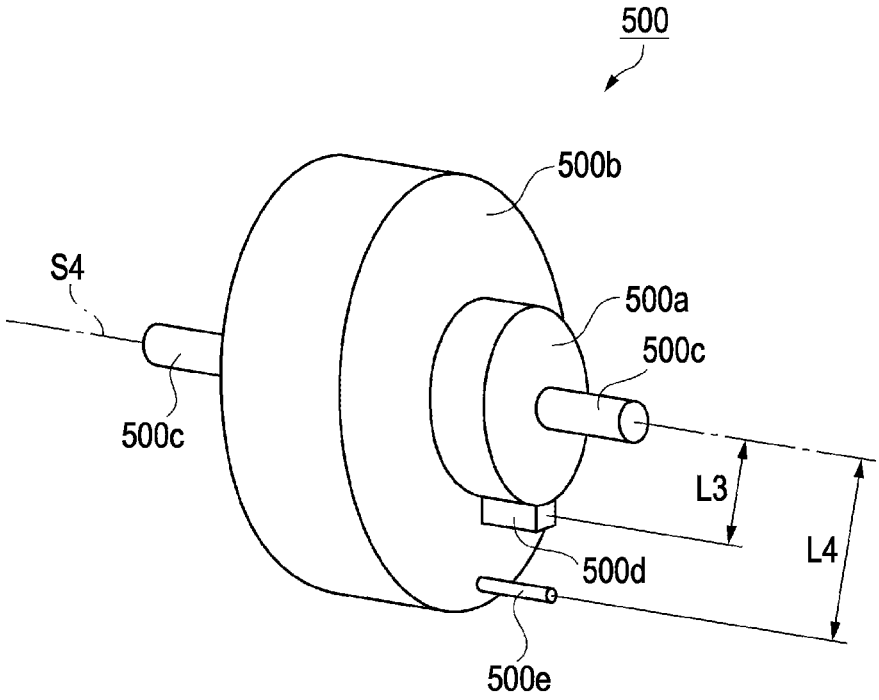
FIG. 12 is an exterior perspective view of a cylindrical member as the transmission member in a second embodiment.

In the first embodiment, a state where the lever 150 is used as the transmission member was described; however, in the second embodiment, a state where the cylindrical member is used as the transmission member will be described. FIG. 12 is an exterior perspective view of a cylindrical member 500 as the transmission member in the present embodiment. In other respects, the configuration of the cylindrical member 500 in the loading device of the second embodiment is the same as the configuration of the loading device in the first embodiment.

The cylindrical member 500 includes a first cylindrical member 500*a* and a second cylindrical member 500*b*. The first cylindrical member 500*a* is provided with an abutting portion 500*d* on which the protruding portion 11*a* of the cassette 11 abuts. The second cylindrical member 500*b* is provided with a connection portion 500*e* as a cylindrical member to which the coil spring 160 is connected.

The first cylindrical member 500*a* and the second cylindrical member 500*b* are fixed to a shaft portion 500*c*. When the protruding portion 11*a* of the cassette 11 abuts on the abutting portion 500*d*, the abutting portion 500*d* and the connection portion 500*e* rotate on a rotation axis S4 as a rotation center of the shaft portion 500*c*.

A distance L4 from the rotation axis S4 to the connection portion 500*e* is longer than a distance L3 from the rotation axis S4 to the abutting portion 500*d*. Accordingly, the movement amount of the connection portion 500*e* in the installation direction is larger than the movement amount of the abutting portion 500*d* in the installation direction.

Third Embodiment

In the first embodiment, a state where the slider 130 sliding in the installation direction D2 along the groove portions 120*a* of the base 120 is used as the first damper portion 200 (see FIGS. 7A and 7B) configuring the damper mechanism portion was described. However, the damper mechanism portion may include a friction portion causing a rod-like member to slide with respect to the cylindrical member, by inserting a rod-like member in the hollow cylindrical member. In other respects, the configuration of the damper mechanism portion in the loading device of the third embodiment is the same as the configuration of the loading device in the first embodiment.

Figure 13:
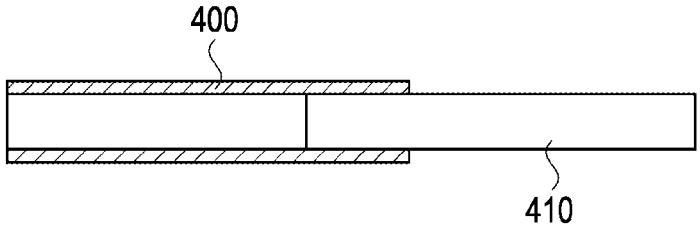
FIG. 13 is a cross sectional view of a damper mechanism portion in a third embodiment.

FIG. 13 is a cross sectional view of a damper mechanism portion in the third embodiment. The damper mechanism portion in FIG. 13 is created by inserting a rod-like member 410 having an outer dimension smaller than the inner dimension of the hollow portion of a cylindrical member 400 into the cylindrical member 400. The outer circumferential surface of the rod-like member 410 slides on the inner circumferential surface of the cylindrical member 400 in the axis direction.

A viscous material (not shown) may be disposed on the contact surface between the cylindrical member 400 and the rod-like member 410 so as to function as an oil damper.

The first to third embodiments have described an ink jet printer. However, the embodiments are also applicable to a recording device which is provided with a photoreceptor and forms images on the photoreceptor by emitting light.

What is claimed is:

1. A recording device comprising:

a cassette in which a plurality of recording media is accommodated by being stacked;

an installation portion in which the cassette is installed due to the movement of the cassette in installation direction;

a transmission member which has a shaft portion, an abutting portion, and a connection portion, wherein the distance between the shaft portion and the abutting portion is shorter than the distance between the shaft portion and the connection portion, the transmission member transmitting a force that the abutting portion receives from the cassette to the connection portion as an acting force by rotating on the shaft portion as a rotation axis when the cassette abuts on the abutting portion due to the movement of the cassette in the installation direction;

a damper mechanism portion connected to the connection portion in the transmission member and receiving the acting force from the connection portion;

a separation slope positioned at downstream side in the installation direction of the cassette and separating the recording media; and a restriction member connected to the damper mechanism portion, restricting the movement of the recording media at an upstream side position in the installation direction of the separation slope, and releasing the restriction on the movement of the recording media by retreating from the position when receiving the acting force from the damper mechanism portion.

2. The device according to claim 1, wherein the transmission member includes a first lever having the shaft portion and the abutting portion and a second lever having the shaft portion and the connection portion.

3. The device according to claim 1, wherein the damper mechanism portion includes a first damper portion configured with a first sliding member-sliding surface, a second sliding member-sliding surface and a viscous material provided between the first sliding member-sliding surface and the second sliding member-sliding surface.

4. The device according to claim 1, wherein the damper mechanism portion includes a second damper portion having an elastic member.

5. The device according to claim 1, wherein when the cassette moves in the installation direction while abutting on the abutting member, a vertical line is included in each positional range of a rotation angle on the rotation axis as a center in at least one of the abutting member and the connection portion.

6. The device according to claim 5, wherein the vertical line is positioned at the center of the positional range of the rotation angle.

* * * * *